US007703759B2

(12) United States Patent
Butler, Jr.

(10) Patent No.: US 7,703,759 B2
(45) Date of Patent: Apr. 27, 2010

(54) BOX SHEET FEEDER METHOD AND APPARATUS

(76) Inventor: Charles Roland Butler, Jr., 4391 Millers Mill Rd., Trinity, NC (US) 27370

( * ) Notice: Subject to any disclaimer, the term of this patent is extended or adjusted under 35 U.S.C. 154(b) by 412 days.

(21) Appl. No.: 11/302,717

(22) Filed: Dec. 14, 2005

(65) Prior Publication Data

US 2007/0132170 A1 Jun. 14, 2007

(51) Int. Cl.
*B65H 3/44* (2006.01)

(52) U.S. Cl. ..... 271/9.13; 493/126

(58) Field of Classification Search ..... 271/9.1, 271/9.04, 9.05, 9.13; 493/121, 122, 126, 493/130, 131, 394

See application file for complete search history.

(56) References Cited

U.S. PATENT DOCUMENTS

| | | | | |
|---|---|---|---|---|
| 3,374,604 | A * | 3/1968 | Roesner et al. | 53/75 |
| 4,023,471 | A | 5/1977 | Royal | |
| 4,731,150 | A | 3/1988 | Wiholm | |
| 4,798,571 | A * | 1/1989 | Everman et al. | 493/114 |
| 4,913,691 | A | 4/1990 | Chaygneaud-Dupuy | |
| 5,656,007 | A | 8/1997 | Olson | |
| 5,806,745 | A * | 9/1998 | Irwin | 226/74 |
| 5,980,440 | A | 11/1999 | Mitman | |
| 6,620,086 | B2 | 9/2003 | Butler et al. | |
| 6,755,773 | B2 | 6/2004 | Ospina | |
| 6,827,678 | B1 | 12/2004 | Kumpel | |
| 2003/0144121 | A1 | 7/2003 | Walsh et al. | |
| 2005/0075231 | A1 | 4/2005 | Mahlum et al. | |

FOREIGN PATENT DOCUMENTS

| | | | |
|---|---|---|---|
| EP | 0280619 | A2 | 8/1988 |
| WO | WO 9813196 | A1 | 4/1998 |

OTHER PUBLICATIONS

Alliance Machine Systems International, LLC., "J&L Specialty Folder Gluer". Mar. 4, 2002. 1 page. http://www.alliancellc.com/news/folder_gluer_update.htm.

* cited by examiner

*Primary Examiner*—Patrick H Mackey
*Assistant Examiner*—Michael C McCullough
(74) *Attorney, Agent, or Firm*—Coats & Bennett, P.L.L.C.

(57) ABSTRACT

An offset sheet feeder comprises a first stack feeder configured to hold a stack of first sheets and to feed individual ones of the first sheets from the stack of first sheets, and a second stack feeder configured to hold a stack of second sheets and to feed individual ones of the second sheets from the stack of second sheets. The second stack feeder is positioned rearward and at a relative offset with respect to the first stack feeder, such that second sheets fed forward from the second stack overlap with first sheets fed from the first stack by an amount related to the relative offset. Aligned, overlapped pairs of first and second sheets can be fed into a box forming apparatus. The offset sheet feeder may include a glue dispenser for depositing adhesive in the overlap area of second sheets fed from the second stack feeder.

12 Claims, 10 Drawing Sheets

BOX SHEET FEEDER METHOD AND APPARATUS

BACKGROUND OF THE INVENTION

The present invention generally relates to box fabrication, and particularly relates to a sheet feeding apparatus for box fabrication.

A common type of box forming apparatus folds flat sheets of material, such as corrugated cardboard, to form box corners. The folding process brings the outside edges of the starting sheet into overlapped alignment, thereby forming a seam that is glued or taped by the apparatus.

Finished box sizes obviously depend on the starting sheet dimensions, and several factors in practice limit sheet size. For example, the sheets, also referred to as "blanks," generally include slots or other cuts corresponding to the top and bottom flaps of the finished box, for example, and the size of blank cutting dies may be limited. Further, the maximum size of preprinted sheets may be limited by printing process capabilities. In theory, one could use a printing apparatus of whatever size was needed for the desired finished box dimensions. Simple economics weigh against this approach, however, because large sheet printers often carry high price premiums.

A more practical approach to forming larger boxes uses two sheets, which are folded together to form a single finished box. The sheet pairs can be individually cut and printed, thereby allowing relatively large finished boxes, while effectively halving the working width requirements of the sheet cutters and printers used to process the sheets in advance of box formation.

While the two-piece approach to large box formation offers upstream cutting and printing advantages, it does complicate the actual folding and gluing operations. For example, proper box formation relies on carefully aligned feeding of the sheet pairs. Further, the two-piece approach involves more complicated seam formation and alignment operations, because two seams are involved, rather than one.

These complications can place significant burdens on machine operators. For example, machine operators may be required to manually overlap and align the sheets in a sheet pair before feeding them into the folding/gluing apparatus. While this manual processing may reduce the required complexity of the folder/gluer apparatus, it requires significant sheet handling by operators and significantly reduces box production as compared to fully automated feeding, folding, and gluing. Some forms of automatic feeding of sheet pairs are known, but these known approaches require potentially large and/or complex feed paths.

BRIEF SUMMARY OF THE INVENTION

One embodiment of an offset sheet feeder as taught herein comprises a first stack feeder configured to hold a stack of first sheets and to feed individual ones of the first sheets from the stack of first sheets, and a second stack feeder configured to hold a stack of second sheets and to feed individual ones of the second sheets from the stack of second sheets, wherein the second stack feeder is positioned rearward and at a relative offset with respect to the first stack feeder. With the laterally offset position of the second stack feeder, second sheets fed forward from the stack of second sheets overlap with first sheets fed from the stack of first sheets by an amount related to the relative offset between the first and second stack feeders.

Correspondingly, one embodiment of a method supporting offset sheet feeding comprises configuring a sheet feeding apparatus to have a second stack feeder in a rearward offset location relative to a first stack feeder, and configuring one or more control systems to coordinate feeding and forward transfer of second sheets from the second stack feeder with feeding and forward transfer of first sheets from the first stack feeder to obtain overlapped and aligned sheet pairs. Positioning the second stack feeder in such a manner results in the inner edges of second sheets that are fed forward from the second stack feeder overlapping with the inner edges of first sheets that are fed forward from the first stack feeder.

Further, the offset sheet feeder may include a glue dispenser to deposit adhesive in the overlap area of the second sheets as they are fed forward. Pre-gluing the overlap area in this manner allows a box forming apparatus operating on the sheet pair to complete the box seam formed by the sheet overlap by compressing the overlap area.

Of course, the present invention is not limited to the above embodiments, features and advantages. Those skilled in the art will recognize additional features and advantages upon reading the following detailed description, and upon viewing the accompanying drawings.

DETAILED DESCRIPTION OF INVENTION EMBODIMENTS

Figure 1:
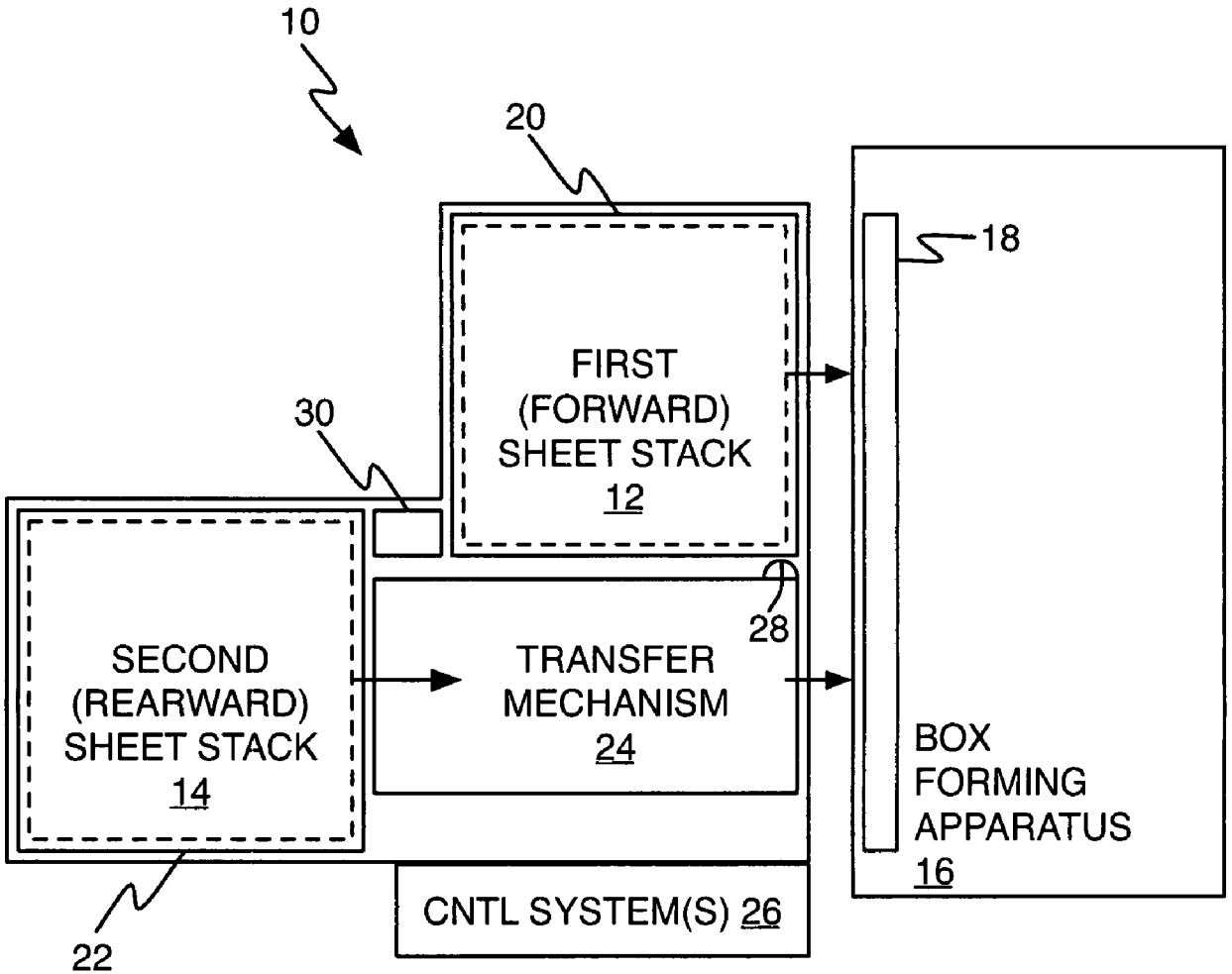
FIG. 1 is a simplified top view block diagram of an embodiment of an offset sheet feeder.

FIG. 1 is a simplified top-view block diagram of an offset sheet feeder 10 according to one embodiment taught herein. The illustrated offset sheet feeder 10 is configured to carry out a method of feeding first and second sheets as overlapped and aligned sheet pairs for box forming. More particularly, the offset sheet feeder 10 overlaps and aligns a sheet fed from a first sheet stack 12 with a sheet fed from a second sheet stack 14.

The overlapped and aligned sheet pair may be fed into a box forming apparatus 16, which may include a feed roller 18 to take in the overlapped and aligned sheet pairs provided by the offset sheet feeder 10. The offset sheet feeder 10 may be separate from, coupled to, or integrated with the box forming apparatus 16. Further, in one or more embodiments, the feed roller 18 is integrated with the offset sheet feeder 10, or is otherwise shared between the offset sheet feeder 10 and the box forming apparatus 16, such that overlapped and aligned sheet pairs are fed from the offset sheet feeder 10 into the box forming apparatus 16.

Regardless, as will be discussed in more detail later herein, providing pre-overlapped and pre-aligned sheet pairs to the box forming apparatus 16 simplifies the operations needed to be performed by it, and eliminates or reduces the manual operations needed to form multi-sheet boxes, i.e., boxes formed from two or more flat sheets, also referred to as "box blanks" herein. It should be understood that various embodiments of the offset sheet feeder 10 taught herein may be manufactured, sold, transported, installed, or otherwise provided, separately from the box forming apparatus 16.

Returning to the illustrated details of FIG. 1, the offset sheet feeder 10 of FIG. 1 comprises a first stack feeder 20 configured to hold the stack of first sheets 12 and to feed individual ones of the first sheets from the stack of first sheets 12, a second stack feeder 22 configured to hold the stack of second sheets 14 and to feed individual ones of the second sheets from the stack of second sheets 14, a transfer mechanism 24 operative to move second sheets fed from the second stack feeder 22 forward relative to the first stack feeder 20, and one or more control systems 26 operative to control sheet feeding, sheet movement, or any combination thereof, to obtain the overlapped and aligned pairs of first and second sheets from the first and second stacks of sheets 12 and 14, respectively, for box forming.

The transfer mechanism 24 may comprise rollers or other conveyor means, and may be configured as a vacuum-based transfer mechanism with spaced-apart vacuum ports along its conveyance length to hold or otherwise retain individual ones of the second sheets as they are moved forward relative to the first stack feeder 20. Further, as will be detailed later herein, the offset sheet feeder 10 may include a glue dispenser 30 positioned in the offset area between the first and second stack feeders 20 and 22 and configured to deposit adhesive along the overlap area of second sheets as they are moved forward from the second stack feeder 22.

Regarding the illustrated embodiment of the second stack feeder 22, one sees that it is positioned rearward of the first stack feeder 20 and laterally offset with respect to the first stack feeder 20 by an amount corresponding to a desired overlap between the first and second sheets in the overlapped and aligned pairs of first and second sheets provided by the offset sheet feeder 10. Among other things, the offset stack configuration provides for convenient, automatic sheet overlapping in a compact physical footprint. For example, the offset stack configuration produces overlapped first and second sheets in a relatively short feed path length as measured in the direction of sheet travel, e.g., a feed path length the same or only nominally greater than the combined length of the first and second stack feeders 20 and 22 as measured in the direction of sheet travel.

With the offset configuration, the control system 26 can be configured to coordinate feeding and forward transfer of second sheets from the second stack feeder 22 with feeding and forward transfer of first sheets from the first stack feeder 20 to obtain overlapped and aligned pairs of first and second sheets for feeding into the box forming apparatus 16. In one embodiment, coordinating the feeding and forward transfer of second sheets from the second stack feeder 22 with feeding and forward transfer of first sheets from the first stack feeder 20 comprises feeding a second sheet from the second stack feeder 22, moving the second sheet forward (via the transfer mechanism 24), detecting an aligned position of the second sheet with respect to the first stack feeder 20, and feeding a first sheet from the first stack feeder 20 responsive thereto, to thereby obtain an overlapped and aligned sheet pair.

More broadly, the control system 26 can be configured to feed a first sheet from the first stack feeder 20 responsive to detecting movement of a second sheet into a predetermined alignment position relative to the first stack feeder 20. The control system 26 may include or be associated with one or more detectors that are operative to detect the presence of the second sheet in the predetermined alignment position. By way of non-limiting example, the detector(s) may comprise photoelectric sensors, or some other type of non-contact detectors.

Figures 2, 3, 4, 5, 6:
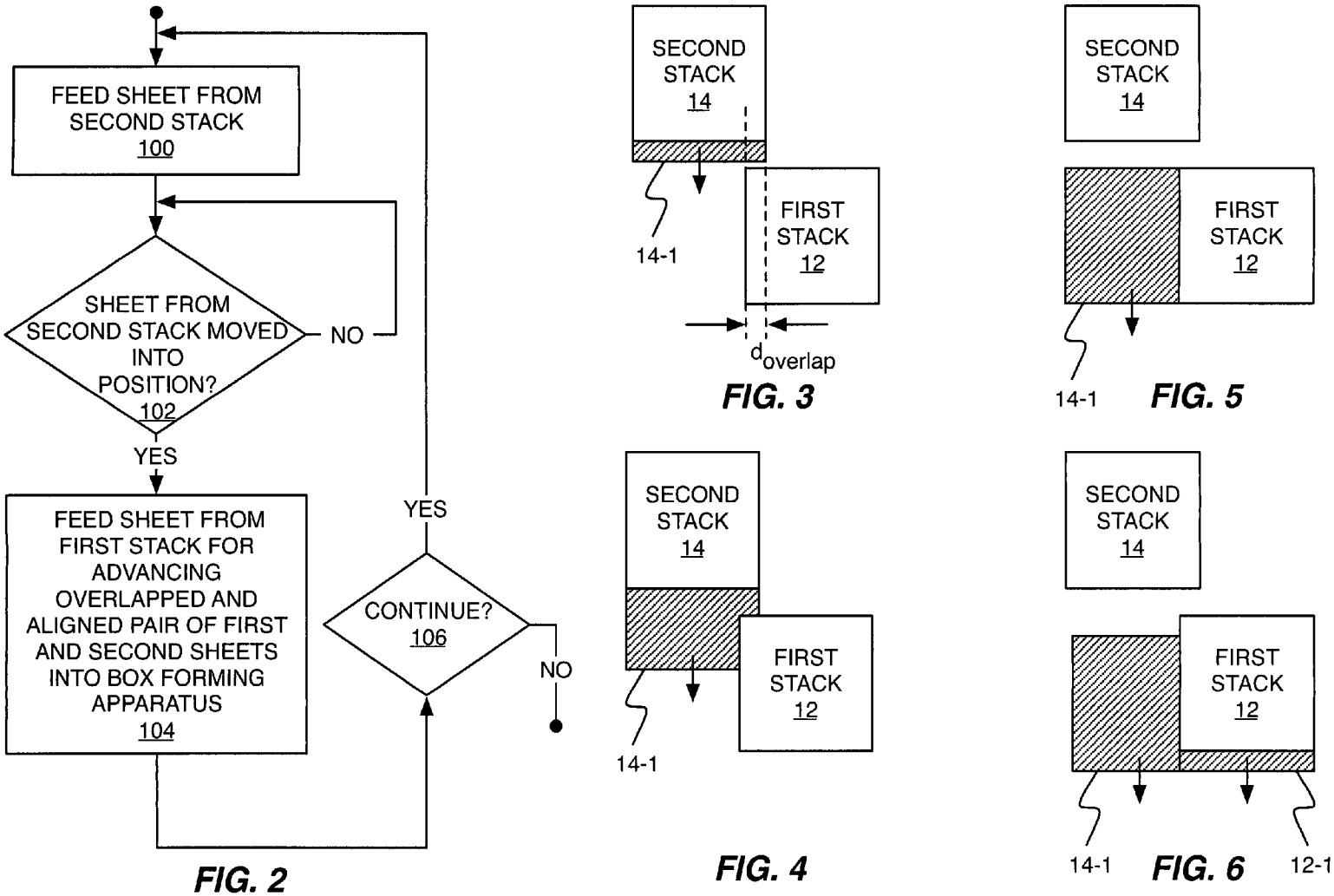
FIG. 2 is a logic flow diagram illustrating an embodiment of offset sheet feeder control logic.
FIGS. 3-6 are diagrams illustrating sheet feeding operations according to an embodiment of offset sheet feeder control logic.

With these broad control embodiments in mind, FIG. 2 is a logic flow diagram illustrating one embodiment of a sheet feeding method that can be implemented through appropriate configuration of the control system(s) 26 of the offset sheet feeder 10. To that end, the one or more control systems 26 may comprise one or more programmable logic controllers (PLCs) or other "ladder logic" type controllers, or may comprise one or more general-purpose and/or special purpose processing circuits, such as microprocessors, field programmable gate arrays (FPGAs), application specific integrated circuits (ASICs), or complex programmable logic devices (CPLDs). Such embodiments may store computer program instructions or other appropriately programmed or configured memory devices, to implement the desired control functionality.

Further, it should be understood that the one or more control systems 26 include, or are associated with, sensors, controllers, actuators, and the like, as needed to monitor and control operations of the offset sheet feeder 10. Finally, it should be understood that the control system(s) 26 may comprise a unitary or otherwise consolidated control system, or may comprise distributed control elements.

Returning to the logic flow diagram, it should be appreciated that FIG. 2 illustrates sequential processing for ease of discussion, but at least some of the illustrated operations may be performed in a different order, or may be performed concurrently. With that in mind, the illustrated processing "begins" with feeding a sheet from the stack of second sheets 14 (Step 100). (One may refer to FIG. 3 for an illustration of a second sheet 14-1 being fed from the stack of second sheets 14. One also sees in FIG. 3 an illustration of the desired offset distance, $d_{overlap}$, produced by positioning the second stack feeder 22 rearward and laterally offset relative to the first stack feeder 20.)

The transfer mechanism 24 moves the second sheet 14-1 forward relative to the first stack feeder 20—this can be seen in FIG. 4—and processing continues with determining whether the (second) sheet has moved into an aligned position with respect to the first stack feeder 20 (Step 102). For example, referring again to FIG. 1, one sees that the offset sheet feeder 10 may include a detector 28, e.g., a photoelectric eye or other electro-optic detector, a capacitive or inductive sensor, or other electrical, mechanical, or electromechanical sensor adapted for detecting the presence or absence, or movement of a sheet.

After the second sheet 14-1 moves into the aligned position, as shown in FIG. 5, processing as illustrated in FIG. 2 continues with feeding a first sheet 12-1 from the first stack feeder 20, for advancing the first sheet 12-1 and the second sheet 14-1 as overlapped and aligned sheet pairs for feeding into the box forming apparatus 16 (Step 104). (The overlapped and aligned sheet pair comprising sheets 12-1 and 14-1 is shown FIG. 6. Notably, the leading edges of the two sheets 12-1 and 14-1 comprising the sheet pair are aligned for feeding into the box forming apparatus 16—not shown in FIG. 6.) Processing continues with checking the "run" state of the offset sheet feeder 10 as a means of determining whether to continue with sheet feeding operations (Step 106). If continued operation is desired, the offset sheet feeder 10 repeats the actions identified in processing blocks 100-104—i.e., it produces another overlapped and aligned sheet pair. If continuation is not desired, such as by activation of a "stop" command, or detection of a machine malfunction, the offset sheet feeder 10 stops or otherwise suspends its sheet feeding operations.

Thus, the above-described embodiment of the offset sheet feeder 10 implements a method of providing first and second sheets for box forming as overlapped and aligned pairs of first and second sheets. Broadly, the method comprises feeding a second sheet from the second stack feeder 22, which is positioned in a rearward offset location relative to the first stack feeder 20, advancing the second sheet forward relative to the first stack feeder 20, and feeding a first sheet from the first stack feeder 20 into an overlapping arrangement with the second sheet. Feeding of the first sheet may be initiated responsive to detecting that the second sheet is advanced to a predetermined position, which may be sensed or otherwise indicated by the detector 28.

Figure 7:
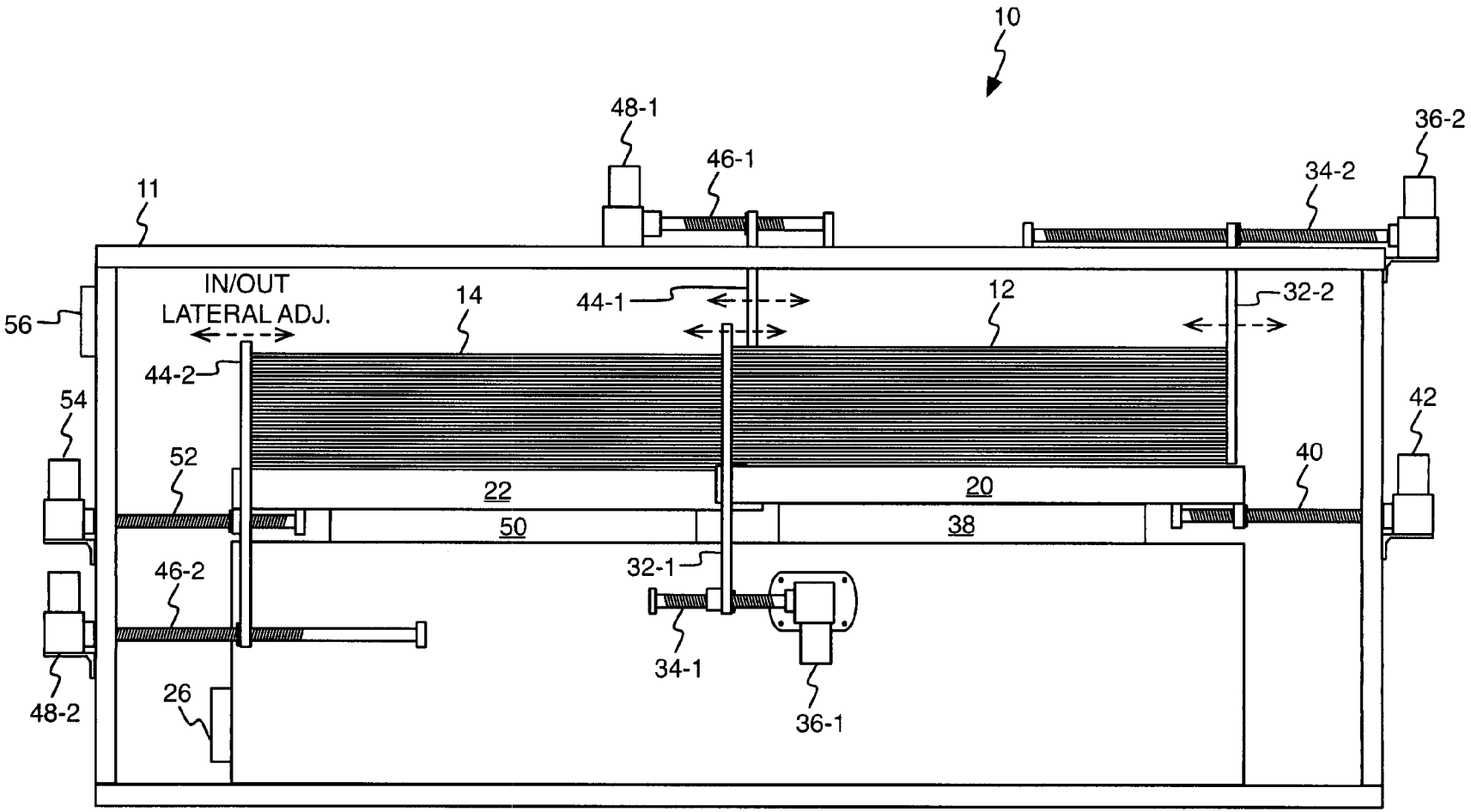
FIG. 7 is a simplified front view diagram of one embodiment of an offset sheet feeder.

Turning from the above basic sheet feeding details to offset sheet feeder configuration details, FIG. 7 illustrates a simplified front view of one embodiment of the offset sheet feeder 10, wherein the first stack of sheets 12 are held by side guides 32-1 and 32-2, which are movably secured to linear screws 34-1 and 34-2, respectively. In turn, directional motors 36-1 and 36-2 drive the linear screws 34-1 and 34-2, such that the side guides 32-1 and 32-2 can be moved inward or outward to adjust the offset of the stack of first sheets 12 relative to the stack of second sheets 14, and to accommodate different sizes of sheets.

Similarly, the first stack feeder 20 rides on one or more rails 38, such that its lateral position can be adjusted by driving a linear screw 40 via a directional motor 42. A similar arrangement is used for the second stack feeder 22. More particularly, for the second stack feeder 22, side guides 44-1 and 44-2 are movably mounted to linear screws 46-1 and 46-2, respectively, which are respectively driven by motors 48-1 and 48-2. Also, the second stack feeder 22 rides on one or more rails 50, such that its lateral position can be adjusted by driving a linear screw 52 via a directional motor 54. It should be understood that some embodiments of the offset sheet feeder 10 will omit one or more of the above adjustability features. For example, the motorized side guides may be omitted from one or both of the stack feeders 20 and 22 and/or the motorized lateral adjustment features may be omitted from one or both of the stack feeders 20 and 22.

One also sees in FIG. 7 that an operator interface 56 may be included in the offset stack feeder 10, for starting, stopping, and configuring the offset stack feeder 10. For example, the operator interface 56 may be configured to allow operators to configure the offset stack feeder 10 for different sheet sizes and different desired overlaps. In one or more embodiments, the operator interface includes a display screen and a keypad—or equivalent touch-screen capabilities—and provides a menu-driven interface supporting configuration and operation of the offset sheet feeder 10.

Figure 8:
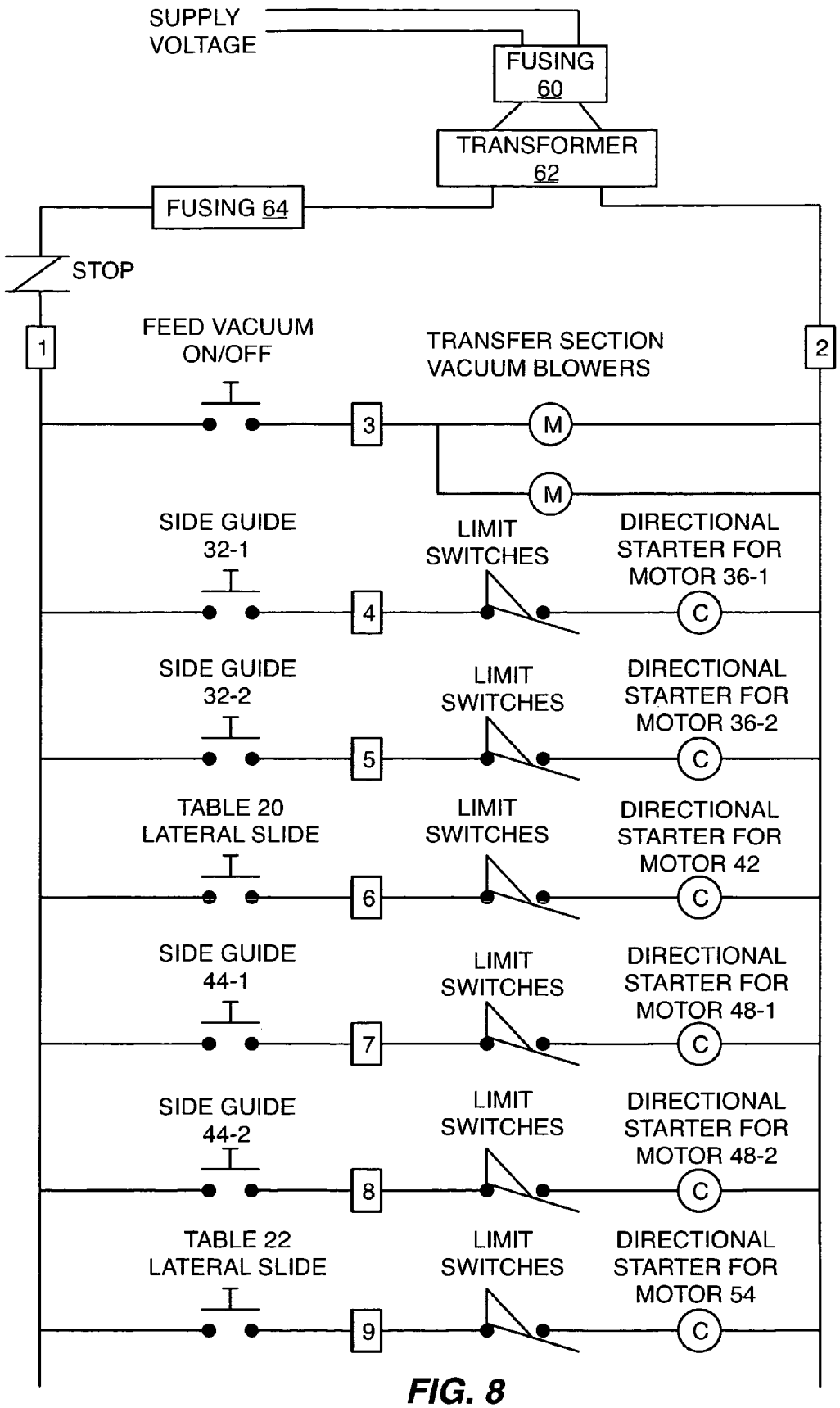
FIG. 8 is a ladder diagram of motor control for one embodiment of the offset sheet feeder of FIG. 7.

With regard to such operations, FIG. 8 illustrates a simplified control arrangement applicable to the collection of motorized screws illustrated in FIG. 7. More particularly, FIG. 8 illustrates a supply voltage coupled through fusing 60 to a transformer 62, which provides output supply connections for powering the various motors. Such supply connections may be protected by additional fusing 64, however, it should be understood that such details can be varied as needed or desired. In any case, one sees that directional motor starters and contactors may be provided to allow coordinated and independent control of side guide and feeder positions.

Figure 9:
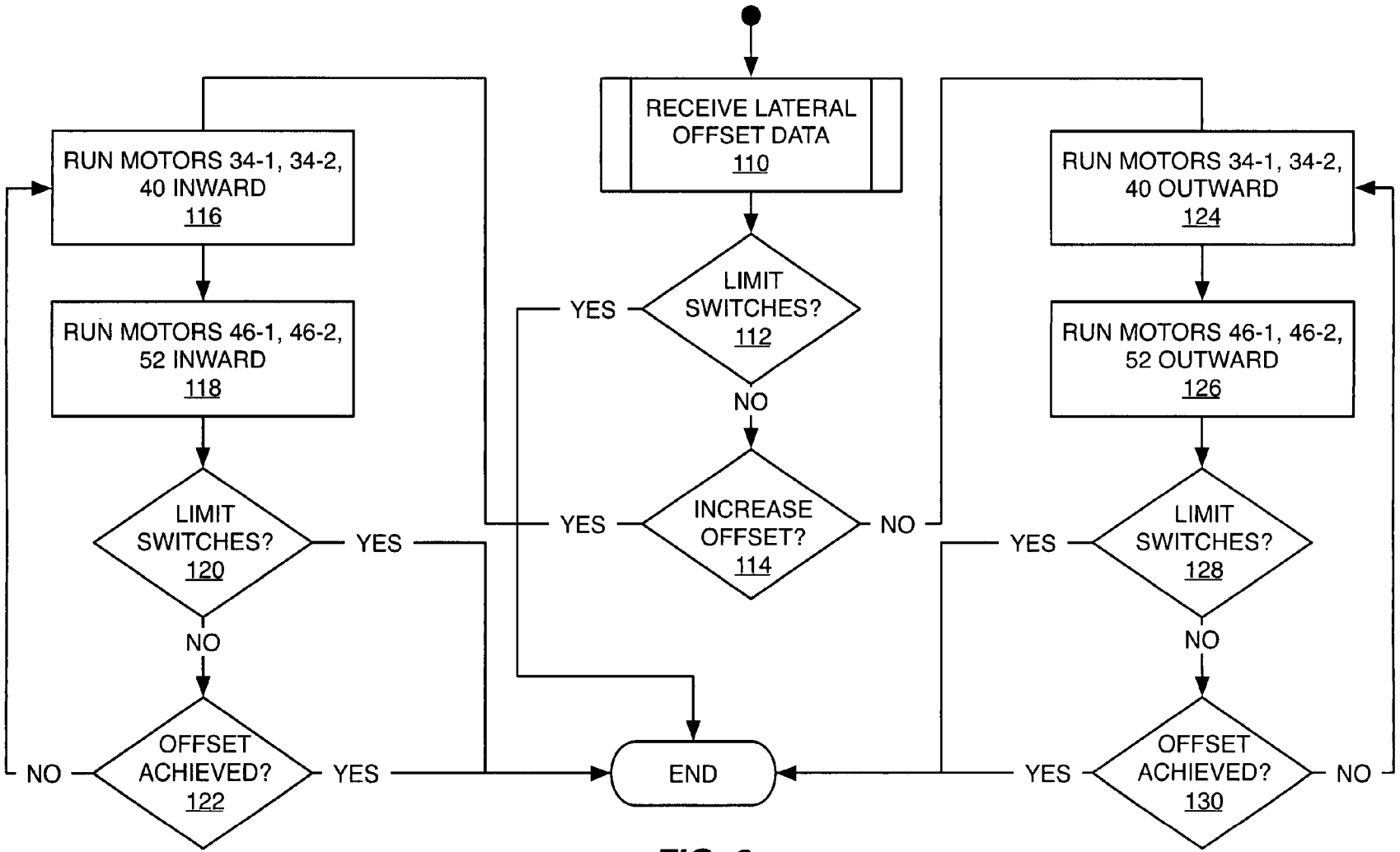
FIG. 9 is a logic flow diagram illustrating an embodiment of lateral offset control for the offset sheet feeder of FIG. 7.

For example, the logic flow diagram presented in FIG. 9 illustrates one embodiment of processing logic for adjusting the lateral offset between the first and second stacks of sheets 12 and 14 to control the amount of overlap in the sheet pairs fed from the offset sheet feeder 10. That is, as an optional feature, the relative offset between the sheet stacks 12 and 14 may be adjusted as needed or desired, to control the amount of sheet overlap. In at least one such configuration, the glue dispenser 30 is mounted to the second stack feeder 22, or otherwise moves laterally, such that its position changes correspondingly with lateral offset adjustments. Further, the dispensing width of the glue dispenser 30 may be adjustable to reflect changing widths in the overlap area.

Regardless of these glue dispenser details, the illustrated embodiment of lateral offset adjustment processing "begins" with receiving lateral offset data (Step 110), such as via the operator interface 56. In at least one embodiment, the offset sheet feeder 10 is configured to sensor or otherwise track the side guide positions, such that the operator enters a desired offset value and the offset sheet feeder 10 automatically adjusts the side guide positions as needed to set the desired offset. Of course, all such movement can be limited to allowable ranges via limit switches, which can be configured to detect and/or stop movement of the side guides 32-1, 32-2, 44-1, and 44-2 at minimum and maximum lateral positions (Step 112).

Assuming that the desired lateral offset is greater than the current amount of lateral offset (yes from Step 114), processing continues with running the motors 34-1 and 34-2 such that the linear screws 34-1 and 34-2 drive the side guides 32-1 and 32-2 laterally inward toward the center (Step 116). Note that the motor 42 optionally can be operated to move the stack feeder 20 inward as well, for example to keep the side guides 32-1 and 32-2 centered on the stack feeder 20. Subsequently or simultaneously, the motors 48-1 and 48-2 may be operated such that the linear screws 46-1 and 46-2 drive the side guides 44-1 and 44-2 laterally inward toward the center (Step 118). As with motor 42, the motor 52 optionally can be operated to the move stack feeder 22 inward as the side guides 44-1 and 44-2 are moved inward.

Subject to limit switch checks (Step 120), side guide adjustment can be continued until the desired offset is achieved (122). Again, the position of the side guides may be detected or otherwise tracked. For example, tracking may comprise starting side guide adjustment from a known position and tracking motor direction and revolutions (and/or linear screw rotations), while detection may be based on sensing the actual position of the side guides, such as through optical sensors or other means.

If a decrease in lateral offset is desired (no from Step 114), the pairs of side guides can be moved away from each other. That is, the illustrated processing to decrease the lateral offset includes running the motors 34-1 and 34-2 to move the side guides 32-1 and 32-2 outward (Step 124) and simultaneously or subsequently running the motors 46-1 and 46-2 to move the side guides 44-1 and 44-2 outward (Step 126). Subject to the corresponding limit switch checks (Step 128), such movement can be continued until the desired lateral offset is achieved (Step 130).

It should be understood that the amount of lateral offset between the stacks of first and second sheets 12 and 14 can be adjusted in other ways. For example, even with fixed side guides, the lateral offset can be adjusted by moving one stack feeder relative to the other. Thus, the lateral offset can be increased or decreased by operating the motor 54 to laterally move the stack feeder 22 along the rail(s) 50 via the linear screw 52. Alternatively or additionally, the stack feeder 20 can be moved laterally toward or away from the stack feeder 22 by operating the motor 42.

Further, it should be understood that, in one or more embodiments, the offset sheet feeder 10 is configured for manual adjustment of lateral offset, such as by manually driven linear screws. Still further, in one or more embodiments, the lateral offset is not adjustable and the features supporting laterally movable side guides and/or laterally movable stack feeders can be omitted.

Figure 10:
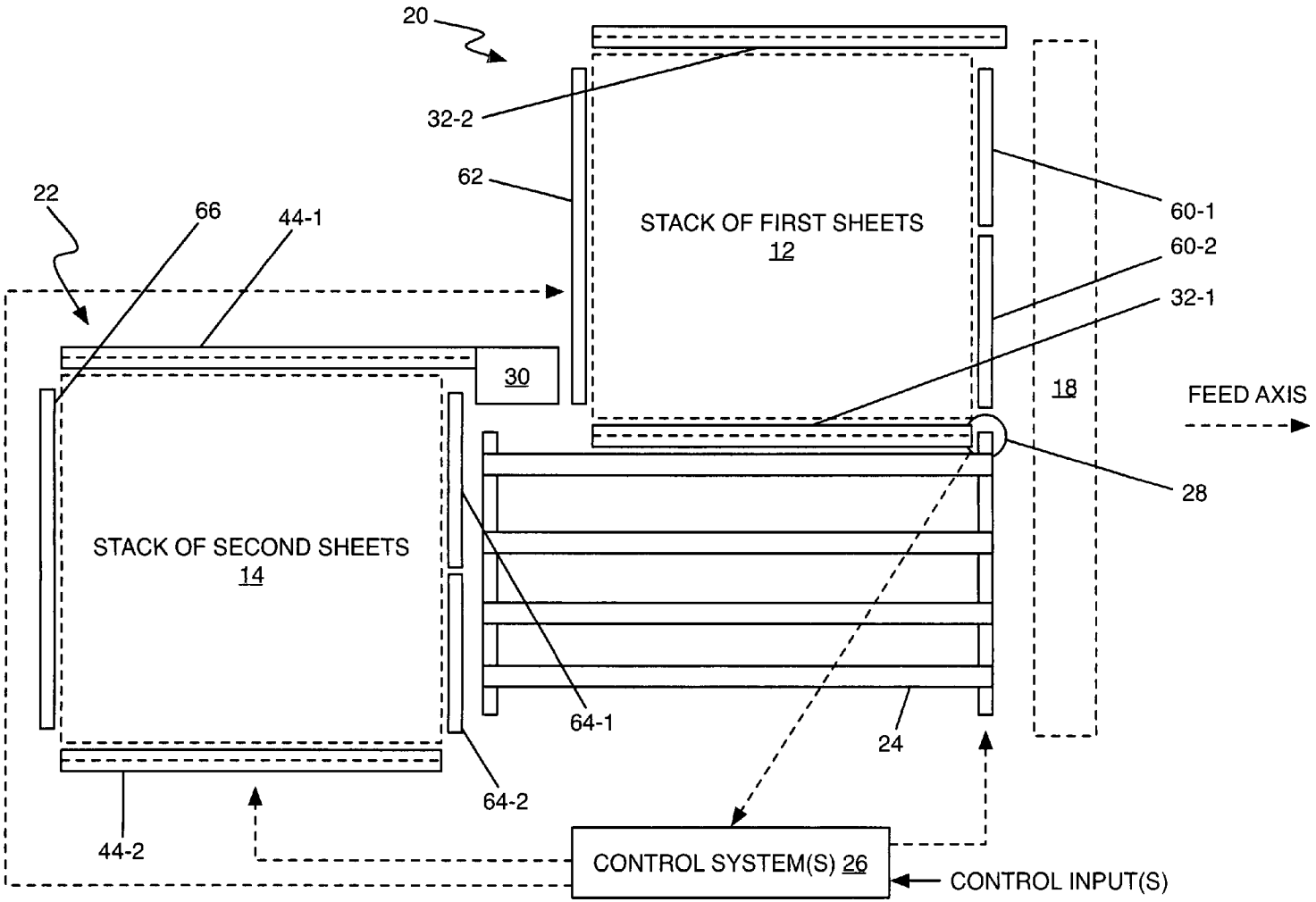
FIG. 10 is a simplified top view diagram of an embodiment of an offset sheet feeder.

Turning to other operational details, FIG. 10 illustrates a top view of one embodiment of the offset sheet feeder 10, wherein the illustration details the inclusion of the inner and outer side guides 32-1 and 32-2, respectively, along with a pair of front guides 60-1/2 and a back guide 62, in association with the first stack feeder 20. Similarly, one sees the inner and outer guides 44-1 and 44-2, respectively, along with a pair of front guides 64-1/2 and a back guide 66, in association with the second stack feeder 22.

The front guides 64-1/2 may be configured as an alignment/feed gate for feeding sheets from the second stack feeder 22. Similarly, the front guides 60-1/2 may be configured as an alignment/feed gate for feeding sheets from the first stack feeder 20. Also, the inner guide 44-1 serves as an inner edge alignment rail for sheets in the stack of second sheets 14 and aligns inner edges of at least a portion of the second sheets in the stack of second sheets 14. Similarly, the inner guide 32-1 serves as an inner edge alignment rail for sheets in the stack of first sheets 12 and aligns inner edges of at least a portion of the first sheets in the stack of first sheets 12. As explained before, these guides therefore facilitate overlapping alignment of second sheets fed from the second stack feeder 22 with first sheets fed from the first stack feeder 20.

In further detailing selected aspects of the guides, forming the front guides 60-1/2 and 64-1/2 as two-piece guide pairs allows feeding sheets slightly off square relative to the feed axis. For example, the front guide 60-1 can be set slightly ahead off or slightly behind the front guide 60-2 relative to the feed axis. Doing so slightly cocks the sheets being fed from the stack of first sheets 12, which may be desirable if the feed mechanism of the first stack feeder 20 exhibits a tendency to feed sheets slightly off square. In other words, the front guides 60-1 and 60-2 can be adjusted to compensate for off square feeding of the first stack feeder 20. Similar adjustments can be made for the second stack feeder 22 using the front guides 64-1 and 64-2. Of course, it should be understood that the offset sheet feeder 10 may be implemented without such features.

Regardless of these and other guide details, one sees in FIG. 10 that the control system 26 can be configured to control the first stack feeder 20, the second stack feeder 22, and the transfer mechanism 24, at least in part responsive to sheet detection signals from the detector 28. One sees that sheets fed forward from the stack of second sheets 14 pass over, under, or through, the glue dispenser 30, such that the overlap area along the inner edges of those sheets receive adhesive. More generally, the glue dispenser 30 is positioned in the stack offset area between the first and second stack feeders 20 and 22, such that it deposits adhesive on all or part of an overlap area of individual second sheets as they are moved forward from the second stack feeder 22.

With reference to FIGS. 2-6 for example, the control system 26 can be configured to adjust the feed delay and/or the feeding speed of the first stack feeder 20 relative to the transfer speed of the transfer mechanism 24, such that the leading edge of the sheet 12-1 as fed from the first stack feeder 20 aligns with the leading edge of the sheet 14-1 being conveyed forward by the transfer mechanism 24. Of course, it should be understood that the speed of the transfer mechanism 24 also can be varied, with or without adjustment of the feeding speed of the first stack feeder 20, such that sheets 12-1 and 14-1 are advanced forward in unison with their leading edges aligned, for input to the box forming apparatus 16 as an aligned, overlapping sheet pair.

Figure 11:
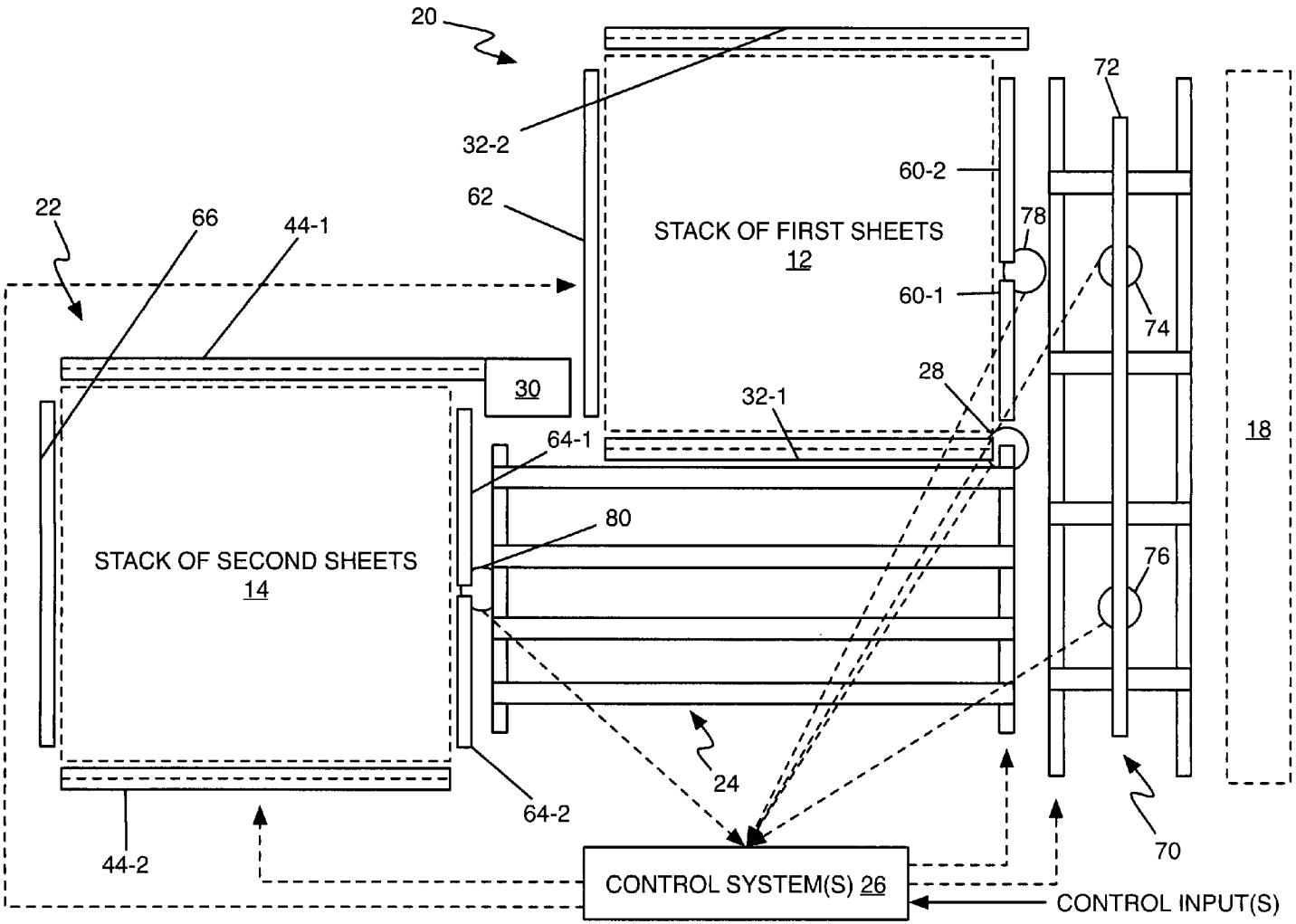
FIG. 11 is a simplified top view diagram of an embodiment of an offset sheet feeder.

As further variations of both control logic and machine configuration, FIG. 11 illustrates an embodiment of the offset sheet feeder 10 wherein a forward transfer mechanism 70, including a forward alignment gate 72 and alignment sensors 74 and 76, is added. More particularly, the alignment sensors 74 and 76 allow the control system 26 to detect that the leading edges of first and second sheets are aligned at the gate 72 of the forward transfer mechanism 70. Further detectors 78 and 80 are optionally added to detect sheets being fed from the first and second stack feeders 20 and 22, respectively. Placement of sheet sensing elements at these locations may be useful, among other things, for checking or verifying stack feeder operations.

With the offset sheet feeder embodiment of FIG. 11, the control system(s) 26 may be configured to coordinate the feeding and forward transfer of second sheets from the second stack feeder 22 with feeding and forward transfer of first sheets from the first stack feeder 20 based on moving leading edges of the overlapped first and second sheets forward to the alignment gate 72, sensing when the leading edges are aligned at the alignment gate 72, and feeding the overlapped sheet pair forward as an overlapped and aligned sheet pair for box forming.

Figure 12:
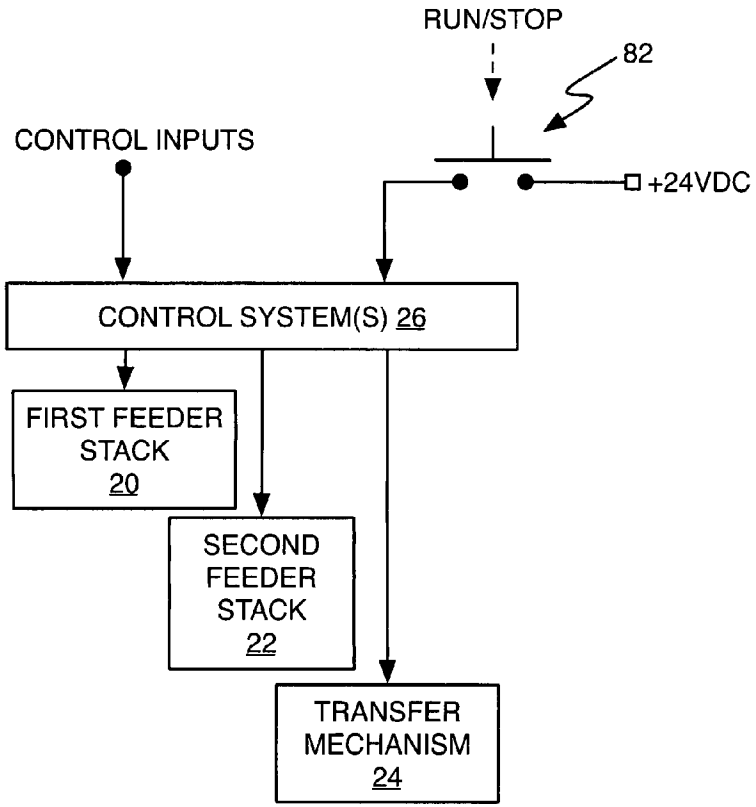
FIG. 12 is a simplified block diagram illustrating an embodiment of offset sheet feeder control logic.

FIG. 12 illustrates an input/output configuration supporting various embodiments of sheet feeding processing logic, such as the sheet feeding operations detailed for FIGS. 10 and 11, wherein the control system 26 receives a detection signal input from the detector 28 and receives a run/stop signal from a run/stop switch 82. The control system 26 outputs one or more control signals for the first and second stack feeders 20 and 22, and may provide control signals for the transfer mechanism 24. For example, the control system(s) 26 asserts a control signal to initiate the feeding of a single second sheet from the second stack feeder 22, and may initiate operation of the transfer mechanism 24 in response, or may allow the transfer mechanism 24 to continue running if it is already operational when the second sheet is fed from the second stack feeder 22. The control system(s) 26 further monitors or otherwise "waits" for a detection signal from the detector 28 as an indication that the second sheet has moved forward into a predetermined alignment position relative to the first stack feeder 20. Responsive to that indication, the control system(s) 26 asserts a control signal to initiate feeding of a single first sheet from the first stack feeder 20 into an overlapping arrangement with the second sheet. Of course, the monitoring and control logic specifically implemented in the control system 26 will vary as a function of, inter alia, the number and location of the sheet position sensors installed.

Figure 13:
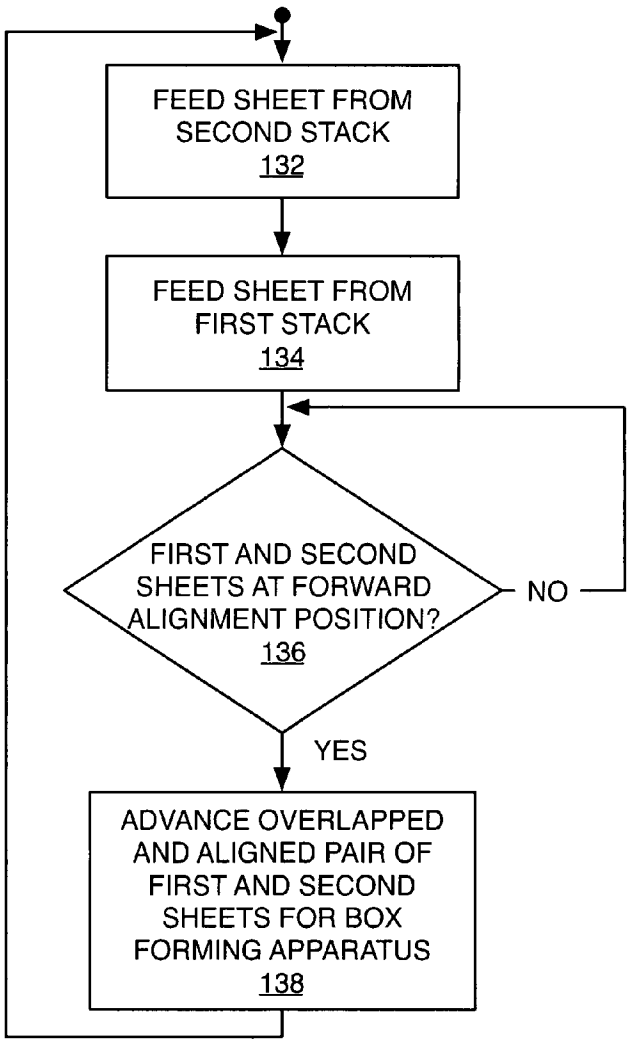
FIG. 13 is a logic flow diagram illustrating an embodiment of sheet feeder control for an offset sheet feeder.

For example, FIG. 13 illustrates one particular embodiment of processing logic complementing the offset sheet feeder embodiment of FIG. 11, which may be implemented in the control system 26. Again, although the diagram illustrates sequentially ordered processing actions, it should be understood that the ordering may be modified at least for some of the illustrated actions and/or that at least some of the illustrated actions may be performed concurrently. With these points in mind, processing "begins" with feeding one of the second sheets from the second stack feeder 22 (Step 132), and feeding one of the first sheets from the first stack feeder (Step 134). The control system 26 may use the detectors 78 and 80 to verify sheet feeding.

Regardless, the second sheet moves forward from the second stack feeder 22 by operation of the transfer mechanism 24, which conveys it to the forward transfer mechanism 70, which in turn moves the second sheet forward against the alignment gate 72. Similarly, the forward transfer mechanism 70 moves the first sheet forward from the first stack feeder 20 forward against the alignment gate 72. The control system 26 detects the presence of the first and second sheets at the alignment gate 72 by virtue of the detectors 74 and 76. Alternatively, one detector or sensor could be used to detect both sheets. Regardless, processing continues with the control system(s) 26 determining whether the first and second sheets are both in their forward alignment positions (Step 136). If so, the control system 26 actuates the alignment gate 72 such that forward transfer mechanism 60 advances the first and second sheets forward to the box forming apparatus 16 as an overlapped and aligned sheet pair (Step 138).

Figure 14:
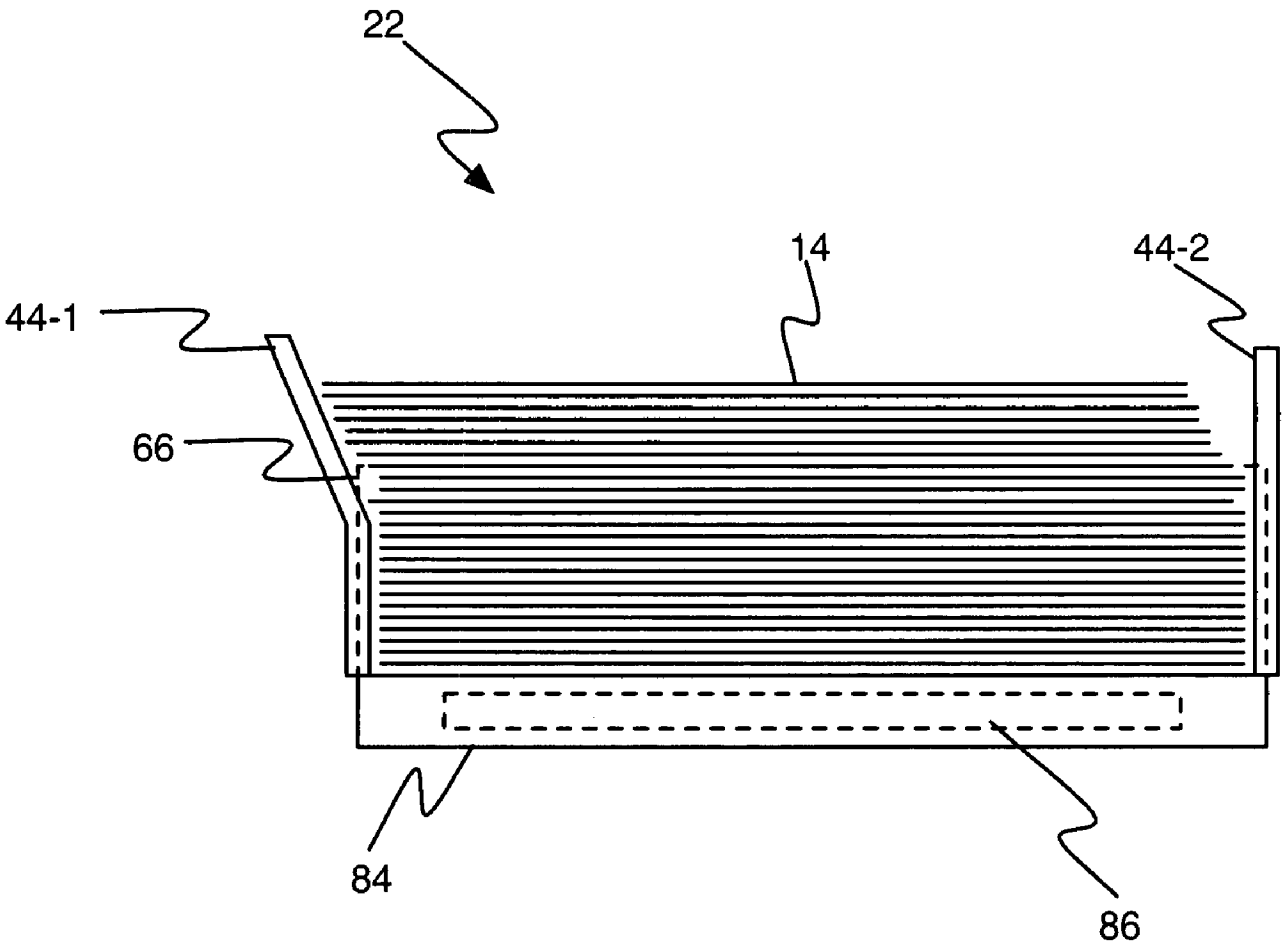
FIG. 14 is a block diagram partially illustrating a rear view of a second stack feeder for use in an offset sheet feeder.

Of course, other or additional detector locations, and other control methods may be used to control overlapped and aligned sheet pair feeding. Turning at least momentarily from these and other control-related examples, it should be noted that the offset sheet feeder 10 may include additional variations. For example, FIG. 14 depicts a rear view of the second stack feeder 22—i.e., looking forward in the direction of sheet travel. In the illustration selected elements are omitted for clarity. With that in mind, one sees that the inner side guide 44-1 may be angled, curved, or otherwise may be designed such that its inner surface is configured to urge the inside edges of the stacked second sheets into vertical alignment for better feeding and better alignment with the individual ones of the first sheets fed from the first stack feeder 20.

One also sees that the second stack feeder 22 further includes a lower stack platform or table base 84, which includes a feed mechanism 86 operative to feed individual ones of the second sheets from the bottom of the stack of second sheets 14. It should be understood that top-feeding stack configurations are also contemplated herein for the stack feeders 20 and 22.

Figure 15:
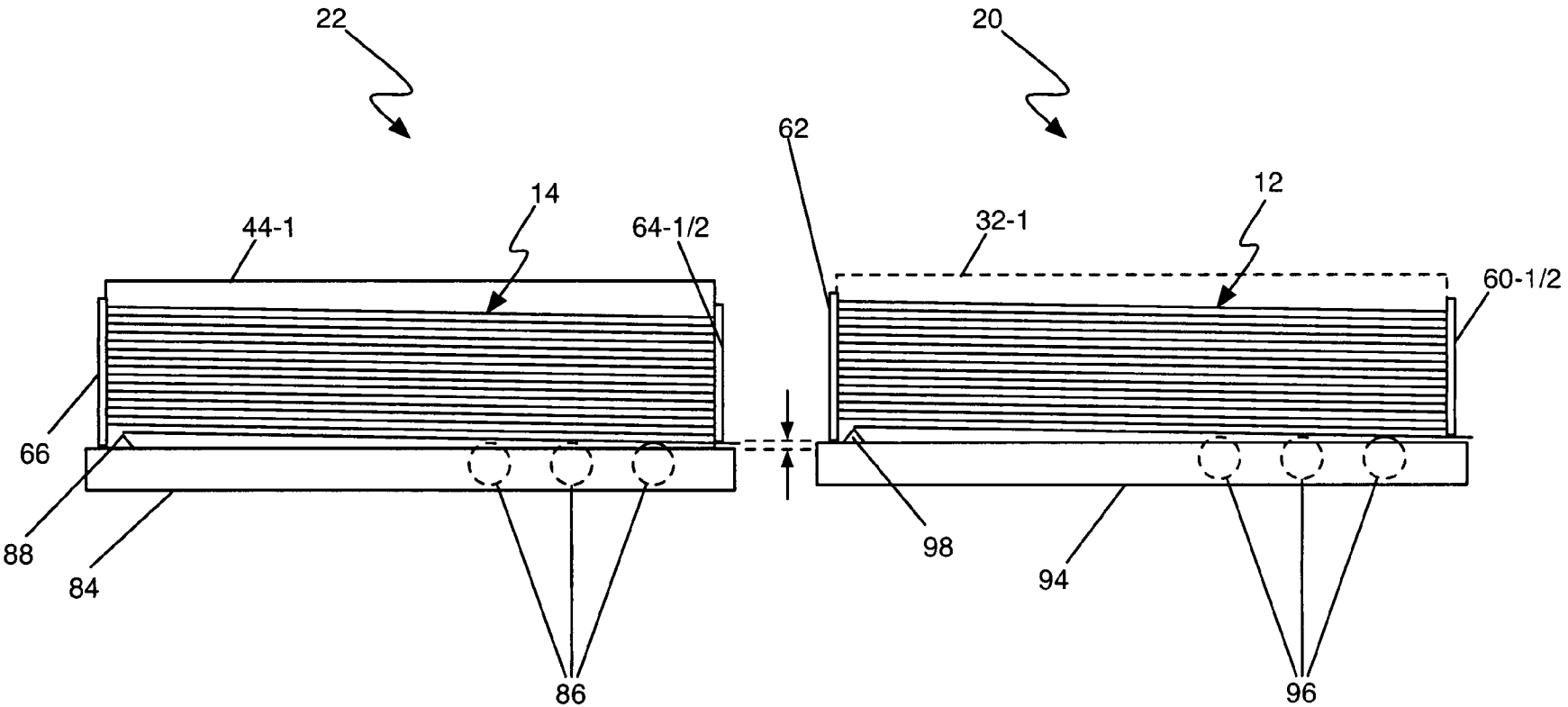
FIG. 15 is a block diagram partially illustrating a side view of first and second stack feeders for use in an offset sheet feeder.

FIG. 15 provides further stack feeder details by presenting a side view of the first and second stack feeders 20 and 22 (with selected elements omitted for clarity). From the illustration, it may be seen that the first stack feeder 20 can be configured the same or similar to the second stack feeder 22. For example, the illustrated first stack feeder 20 includes a base 94 and a feed mechanism 96 that may be the same as the base 84 and the feed mechanism 86 of the second stack feeder 22.

Further, the base 84 of the second stack feeder 22 may include a rearward projection 88 that keeps the leading edge of at least the bottommost stack sheet angled downward toward the feed mechanism 86 to facilitate sheet feeding. Similarly, the base 94 of the first stack feeder 20 may include a rearward projection 98 for the same purpose. Note, too, that the feed mechanisms 86 and 96 may comprise one or more rows of motorized feed rollers respectively carried within the bases 84 and 94. Vacuum assistance may be used for the feed mechanisms 86 and 96.

It also may be noted from the illustration that the second stack feeder 22 can be vertically offset from the first stack feeder 20 by a desired amount—vertically offset of the feeder stacks 20 and 22 also can be seen in the front-view illustration of FIG. 7, for example. That is, the first and second feeder stacks 20 and 22 may be positioned at different elevations to facilitate the overlapping feed arrangement produced by placing the second stack feeder 22 at a rearward offset relative to the first stack feeder 20. For example, for a bottom-feed configuration of the stack feeders 20 and 22, it may be desirable to position the second stack feeder 22 such that the second sheets feed slightly below the feed plane of the first sheets so that the first sheets overlap the second sheets. Of course, the relative feed heights can be reversed so that the second sheets overlap the first sheets. Moreover, a similar effect can be achieved not by adjusting the relative vertical position of the stack feeders 20 and 22, but rather by adjusting the transfer mechanism angle or elevation, or by various other means. Also, it should be understood that the stack feeders 20 and 22 can be configured for top-feed configurations.

Of course, those skilled in the art will appreciate that a wide variety of stack feeder configurations may be adopted, while still retaining the offset arrangement that yields automatic overlapping of the first and second sheets. Indeed, those skilled in the art will appreciate that the several embodiments described herein represent variations of an offset sheet feeder 10 that broadly encompasses an offset stack arrangement.

That is, broadly, the offset sheet feeder 10 comprises first stack feeder configured to hold a stack of first sheets and to feed individual ones of the first sheets from the stack of first sheets, and a second stack feeder configured to hold a stack of second sheets and to feed individual ones of the second sheets from the stack of second sheets, wherein the second stack feeder is positioned rearward and at a relative offset with respect to the first stack feeder such that second sheets fed forward from the second stack overlap with first sheets fed from the first stack by an amount related to the relative offset between the first and second stack feeders. The offset sheet feeder 10 further comprises the control system 26, which is configured to coordinate feeding of first sheets from the first stack with forward transfer of second sheets from the second stack such that first and second sheets are feed from the offset sheet feeder as overlapped and aligned sheet pairs.

With the above range of variations in mind, it should be understood that the present invention is not limited by the foregoing description, nor is it limited by the accompanying drawings. Instead, the present invention is limited only by the following claims, and their legal equivalents.

What is claimed is:

1. An offset sheet feeder configured to provide aligned and horizontally overlapped pairs of first and second sheets for feeding into in an associated box forming apparatus, said offset sheet feeder comprising:

first and second stack feeders defining a feed path of the offset sheet feeder, said first stack feeder configured to hold a vertical stack of first sheets and to feed individual ones of the first sheets from the vertical stack of first sheets, and said second stack feeder configured to hold a vertical stack of second sheets and to feed individual ones of the second sheets from the vertical stack of second sheets, said second stack feeder positioned rearward and at a relative lateral offset with respect to the first stack feeder;

a control system configured to coordinate feeding and forward transfer of second sheets from the second stack feeder with feeding and forward transfer of first sheets from the first stack feeder, to obtain the aligned and horizontally overlapped pairs of first and second sheets, for feeding into the associated box forming apparatus; and wherein said relative lateral offset of the second stack feeder establishes the amount of horizontal overlap between respective inner edges of the first and second sheets in each aligned and overlapped pair of first and second sheets.

2. The offset sheet feeder of claim 1, wherein an overall length of said feed path as measured in a direction of sheet travel is the same as or only nominally greater than a combined length of the first and second stack feeders, taken along the direction of sheet travel.

3. The offset sheet feeder of claim 1, wherein the first and second stack feeders each include a pair of side guides for aligning sheet edges in the vertical stacks of first and second sheets respectively held by the first and second stack feeders, and wherein the pair of side guides in at least one of the first and second stack feeders comprises laterally movable side guides, which are laterally movable relative to the feed path, to thereby adjust said relative lateral offset of the second stack feeder with respect to the first stack feeder.

4. The sheet feeder of claim 3, wherein said laterally movable side guides are mounted or otherwise carried on motorized linear screws, for motorized adjustment of said relative lateral offset of the second stack feeder with respect to the first stack feeder.

5. The offset sheet feeder of claim 1, wherein a lateral position of at least one of the first and second stack feeders is adjustable, such that the lateral position of the at least one stack feeder is laterally adjustable relative to the feed path, to thereby adjust said relative lateral offset of the second stack feeder with respect to the first stack feeder.

6. The sheet feeder of claim 5, wherein said at least one stack feeder is mounted or otherwise carried on motorized linear screws, for motorized adjustment of said relative lateral offset of the second stack feeder with respect to the first stack feeder.

7. The offset sheet feeder of claim 1, wherein the first and second stack feeders each include a pair of side guides for aligning sheet edges in the vertical stacks of first and second sheets respectively held by the first and second stack feeders, and where, for each stack feeder, an inner edge guide in the pair of side guides is configured as an inner edge alignment rail to align inner edges of sheets fed from the stack feeder.

8. The offset sheet feeder of claim 1, wherein, to form each aligned and overlapped pair of first and second sheets, the control system is configured to feed a given second sheet from the second stack feeder, move it forward toward the first stack feeder via a transfer mechanism included in the offset sheet feeder, detect that the given second sheet moves into a predetermined alignment position relative to the first stack feeder, and, in response to said detection, feed a given first sheet from the first stack feeder, such that it aligns with and horizontally overlaps the given second sheet.

9. The offset sheet feeder of claim 1, further comprising a glue dispenser positioned within the feed path in a stack offset area between the first and second stack feeders, said glue dispenser configured to deposit adhesive on all or part of an overlap area of individual second sheets as they are moved forward along the feed path from the second stack feeder toward the first stack feeder, said overlap area defined as that portion of each second sheet along the inner edge of the second sheet that will horizontally overlap with a corresponding one of the first sheets.

10. The offset sheet feeder of claim 9, wherein said second stack feeder is adjustable in terms of its lateral position within the feed path, to thereby adjust said relative lateral offset of the second stack feeder with respect to the first stack feeder, and wherein said glue dispenser is mounted on the second stack feeder such that its position changes correspondingly with adjustments to said relative lateral offset.

11. The offset sheet feeder of claim 9, wherein the offset sheet feeder is configured such that said relative lateral offset said second stack feeder with respect to the first stack feeder is adjustable, and wherein said glue dispenser is configured to be adjustable in terms of its lateral position within the feed path, such that the lateral position of the glue dispenser is adjustable for adjustments in said relative lateral offset.

12. The offset sheet feeder of claim 1, wherein said first and second stack feeders are positioned at different vertical elevations, to facilitate feeding individual ones of the second sheets from the second stack feeder into overlapping alignment with corresponding ones of the first sheets fed from the first stack feeder.

* * * * *